US011625004B2

(12) United States Patent
Hiraya

(10) Patent No.: US 11,625,004 B2
(45) Date of Patent: Apr. 11, 2023

(54) TIMEPIECE

(71) Applicant: Seiko Epson Corporation, Tokyo (JP)

(72) Inventor: Eiichi Hiraya, Shiojiri (JP)

(73) Assignee: SEIKO EPSON CORPORATION

( * ) Notice: Subject to any disclaimer, the term of this patent is extended or adjusted under 35 U.S.C. 154(b) by 282 days.

(21) Appl. No.: 17/070,996

(22) Filed: Oct. 15, 2020

(65) Prior Publication Data

US 2021/0116866 A1 Apr. 22, 2021

(30) Foreign Application Priority Data

Oct. 16, 2019 (JP) ..... JP2019-189249

(51) Int. Cl.
*G04B 13/02* (2006.01)
*G04B 9/00* (2006.01)

(52) U.S. Cl.
CPC ..... *G04B 9/005* (2013.01); *G04B 13/02* (2013.01)

(58) Field of Classification Search
CPC ..... G04B 9/005; G04B 13/02; G04B 5/02; G04B 5/08
See application file for complete search history.

(56) References Cited

U.S. PATENT DOCUMENTS 3,306,025 A * 2/1967 Kocher ..... G04B 33/06 368/207
6,485,172 B1 * 11/2002 Takahashi ..... G04B 5/14 368/208
11,360,432 B2 * 6/2022 Buehler ..... G04B 17/285
2004/0047244 A1 * 3/2004 Iino ..... H04M 1/21 368/276
2007/0195650 A1 * 8/2007 Kamiya ..... G07C 3/045 368/223
2009/0129211 A1 * 5/2009 Rochat ..... G04B 45/0046 368/208
2011/0205857 A1 * 8/2011 Beccia ..... G04B 5/16 368/208
2015/0198925 A1 * 7/2015 Cornibe ..... G04B 11/006 368/207
2016/0363908 A1 * 12/2016 Kirchhof ..... G04B 5/02

FOREIGN PATENT DOCUMENTS

JP 2017-026460 A 2/2017

* cited by examiner

*Primary Examiner* — Sean Kayes
(74) *Attorney, Agent, or Firm* — Harness, Dickey & Pierce, P.L.C.

(57) ABSTRACT

A timepiece includes a mainspring, a power reserve hand configured to indicate a remaining amount of windup of the mainspring, an indicator wheel provided with the power reserve hand attached thereto, and a solar wheel configured to rotate in a first direction when the mainspring is wound, rotate in a second direction reverse to the first direction when the mainspring is unwound, and provided with at least two pinions, one of the pinions configured to drive the indicator wheel.

3 Claims, 11 Drawing Sheets

TIMEPIECE

The present application is based on, and claims priority from JP Application Serial Number 2019-189249, filed Oct. 16, 2019, the disclosure of which is hereby incorporated by reference herein in its entirety.

BACKGROUND

1. Technical Field

The present disclosure relates to a timepiece including a power reserve display mechanism configured to display a remaining amount of windup of a mainspring.

2. Related Art

There has been known timepieces that include a remaining amount display hand configured to display a remaining amount of windup of a mainspring (refer to, for example, JP-A-2017-26460). In the timepiece of JP-A-2017-26460, the remaining amount display hand is disposed between a dial and a cover glass, similar to an hour hand, a minute hand, and a seconds hand. As a result, a user of the timepiece can check the remaining amount of windup of the mainspring by checking an indicated position of the remaining amount display hand from a front side of the timepiece through the cover glass.

The remaining amount display hand is generally a type visually recognizable from the front side of the timepiece, as in the timepiece of JP-A-2017-26460. On the other hand, timepieces have also been developed in which, in a timepiece of a case back skeleton type which uses glass for the case back of the timepiece, making it possible to visually recognize a movement from the case back, the remaining amount display hand is disposed between the movement and the case back. A user of this timepiece can check the remaining amount of windup of the mainspring by viewing the indicated position of the remaining amount display hand from a back side of the timepiece through the glass of the case back.

The movement that allows visual recognition of the remaining amount display hand from the front side of the timepiece, and the movement that allows visual recognition of the remaining amount display hand from the back side of the timepiece have each been exclusively designed, and thus the remaining amount display has been limited to one of the front side and the back side of the timepiece, according to the movement. Further, in order to effectively utilize both the front side and the back side of the timepiece, a timepiece in which remaining the amount display hands is disposed on both the front side and the back side of the movement, allowing visual recognition of the remaining amount of windup of the mainspring from both the front side and the back side of the timepiece, has been desired. Furthermore, a timepiece having a high ratio of common components of the movement and, by a difference in component assembly, is capable of accommodating a plurality of types of timepiece designs, such as a remaining amount indicator being disposed only on the front side, only on the back side, or on both the front side and the back side of the timepiece, has been desired.

SUMMARY

A timepiece according to the present disclosure includes a mainspring, a power reserve hand configured to indicate a remaining amount of windup of the mainspring, an indicator wheel provided with the power reserve hand attached thereto, and a solar wheel configured to rotate in a first direction when the mainspring is wound, rotate in a second direction reverse to the first direction when the mainspring is unwound, and provided with at least two pinions, one of the pinions configured to drive the indicator wheel.

The timepiece according to the present disclosure may further include an intermediate wheel configured to intermesh with the indicator wheel and one of the at least two pinions.

In the timepiece according to the present disclosure, the at least two pinions may include a first pinion provided to an end portion, on the dial side, of a rotary shaft of the solar wheel and a second pinion provided to an end portion, on a case back side, of the rotary shaft of the solar wheel, the indicator wheel may be driven by the first pinion, and the power reserve hand may be visually recognizable from a front surface side of the timepiece.

In the timepiece according to the present disclosure, the at least two pinions may include a first pinion provided to an end portion, on the dial side, of a rotary shaft of the solar wheel and a second pinion provided to an end portion, on a case back side, of the rotary shaft of the solar wheel, the indicator wheel may be driven by the second pinion, and the power reserve hand may be visually recognizable from a back surface side of the timepiece.

In the timepiece according to the present disclosure, the at least two pinions may include a first pinion provided to an end portion, on the dial side, of a rotary shaft of the solar wheel and a second pinion provided to an end portion, on a case back side, of the rotary shaft of the solar wheel, the indicator wheel may include a first indicator wheel driven by the first pinion and a second indicator wheel driven by the second pinion, and the power reserve hand may include a first power reserve hand attached to the first indicator wheel and visually recognizable from a front surface side of the timepiece and a second power reserve hand attached to the second indicator wheel and visually recognizable from a back surface side of the timepiece.

In the timepiece according to the present disclosure, when, in plan view as viewed from a direction orthogonal to the dial, the timepiece is divided by a line segment connecting a 12 o'clock mark and a 6 o'clock mark of the dial into two regions of a first region including a 3 o'clock mark and a second region including a 9 o'clock mark, the solar wheel may be disposed in the second region.

DESCRIPTION OF EXEMPLARY EMBODIMENTS

First Exemplary Embodiment

A timepiece 1 according to a first exemplary embodiment will be described below on the basis of FIGS. 1 to 6.

Figure 1:
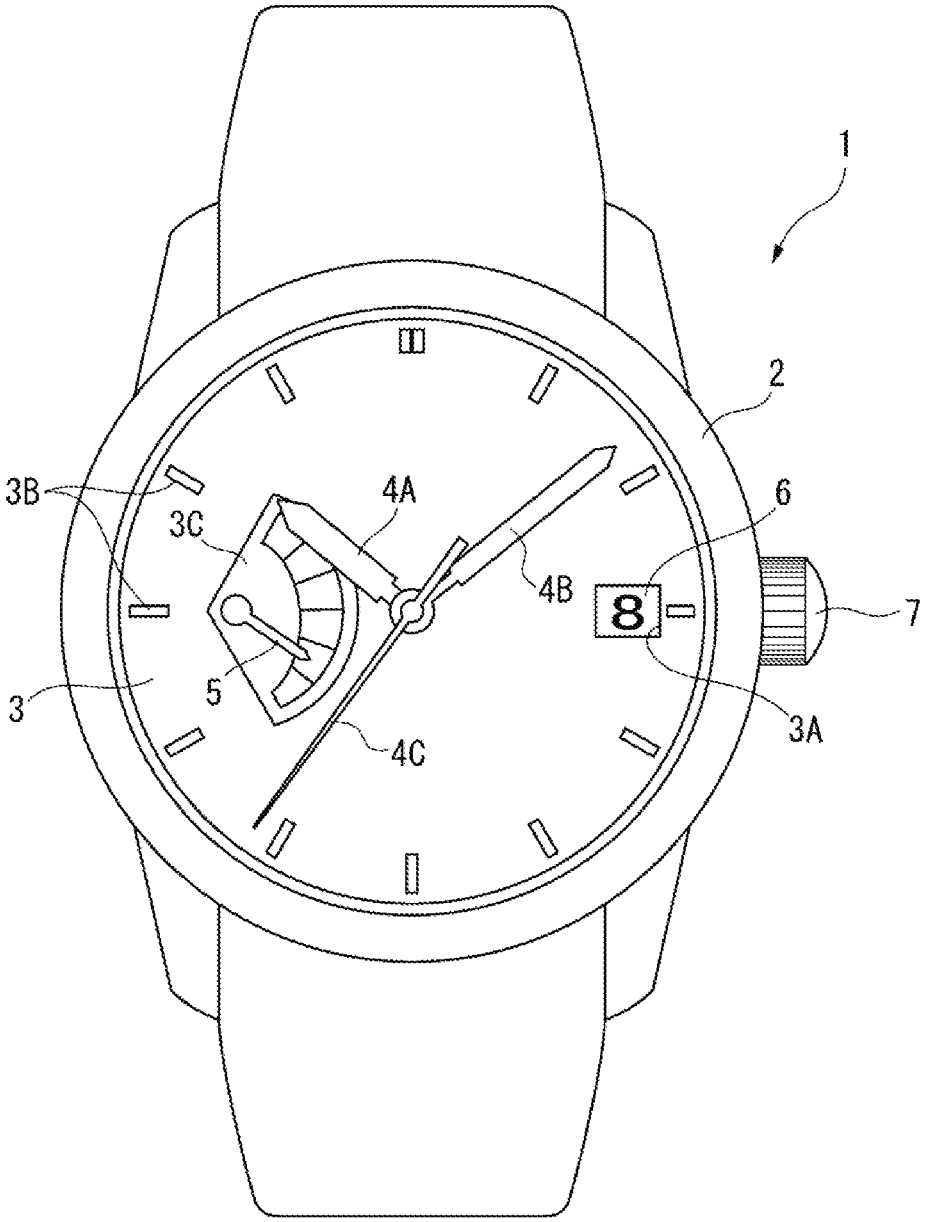
FIG. 1 is a front view illustrating a timepiece of a first exemplary embodiment.

FIG. 1 is a front view illustrating the timepiece 1. The timepiece 1 of the first exemplary embodiment is a type of timepiece that allows visual recognition of a power reserve hand 5 from a front surface side of the timepiece 1. The timepiece 1 is a wristwatch worn on a wrist of a user, includes an outer case 2 having a cylindrical shape, and is provided with a dial 3 disposed on an inner peripheral side of the outer case 2. Of two openings of the outer case 2, an opening on the front surface side is closed by a cover glass, and an opening on a back surface side is closed by a case back.

Figure 2:
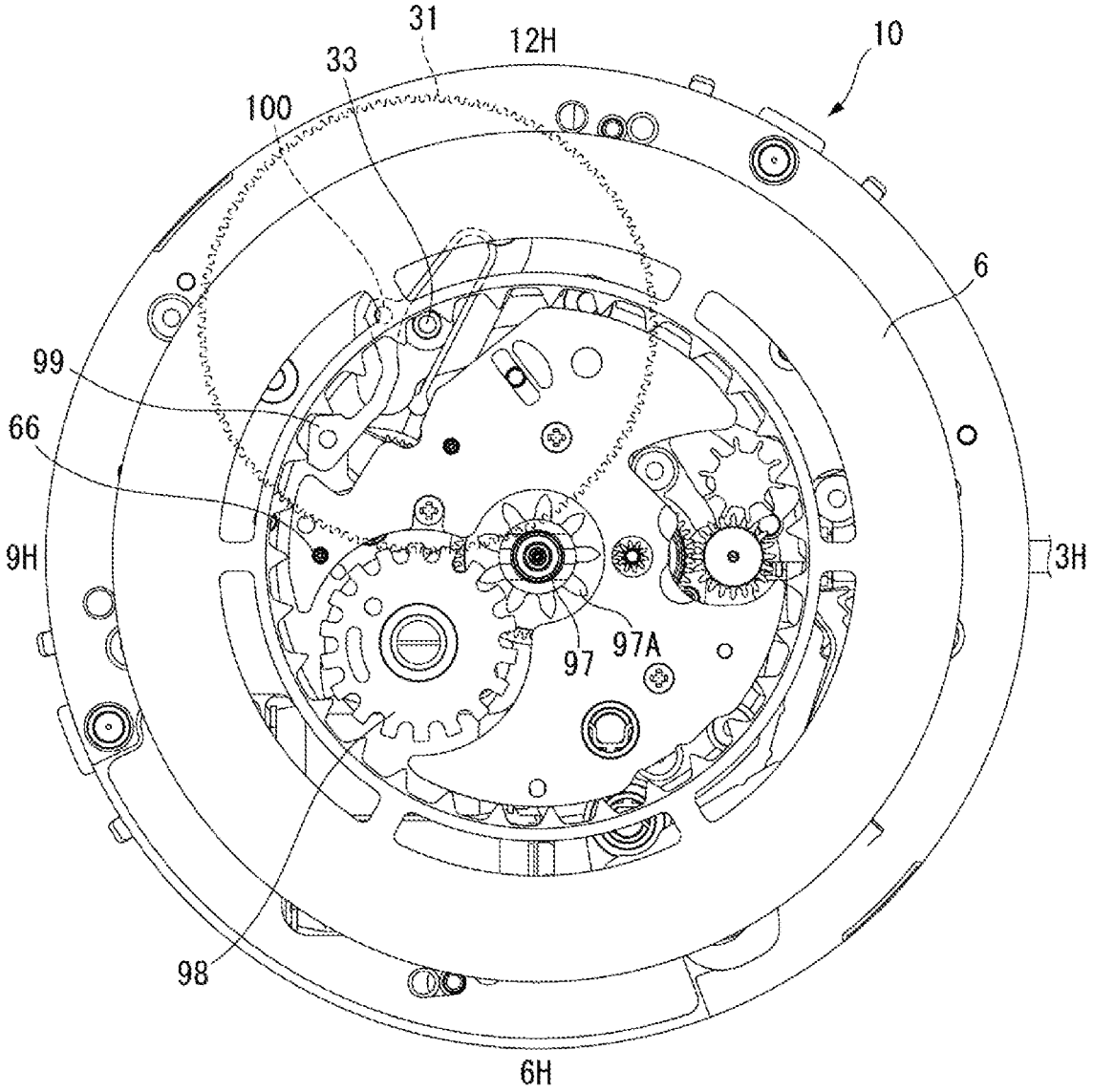
FIG. 2 is a plan view illustrating a movement of the timepiece of the first exemplary embodiment.
Figure 3:
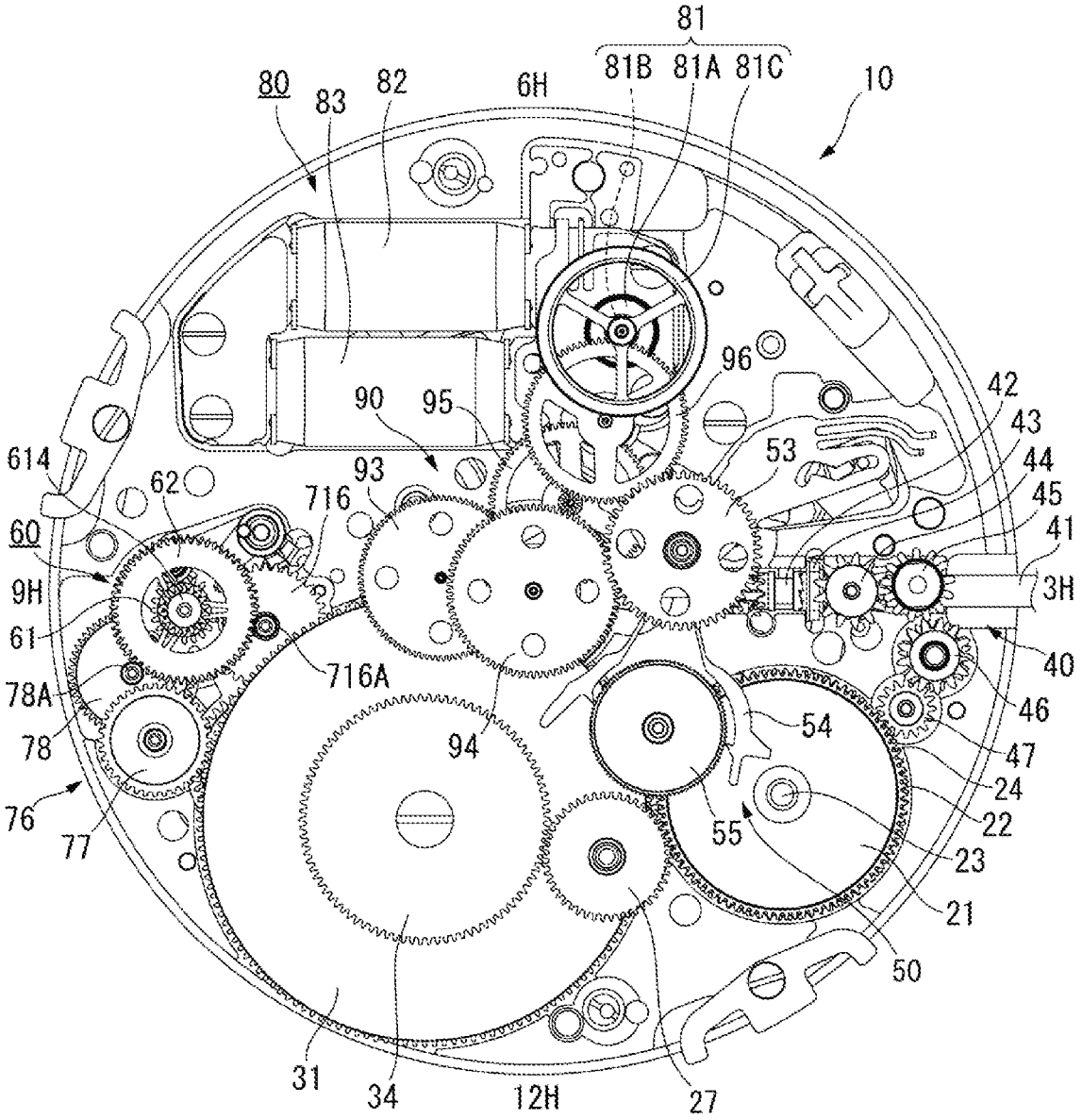
FIG. 3 is a plan view illustrating a main portion of the movement of the timepiece of a first exemplary embodiment.

The timepiece 1 includes a movement 10 accommodated inside the outer case 2 and illustrated in FIGS. 2 and 3, an hour hand 4A, a minute hand 4B, and a seconds hand 4C illustrated in FIG. 1 and configured to indicate time information, and the power reserve hand 5 configured to indicate a remaining amount of windup of a mainspring. A date window 3A is provided to the dial 3, and a date indicator 6 is visually recognizable from the date window 3A. Further, the dial 3 is provided with hour marks 3B for indicating the time, and a sub-dial 3C having a fan shape and for indicating the remaining amount of windup of the mainspring by the power reserve hand 5.

A side surface of the outer case 2 is provided with a crown 7. The crown 7 can be pulled and moved from a 0-step position to a 1-step position and a 2-step position pressed toward a center of the timepiece 1.

When the crown 7 is rotated in the 0-step position, a first mainspring 20 and a second mainspring 30 provided to the movement 10 can be wound as described later. The power reserve hand 5 moves in tandem with the winding of the first mainspring 20 and the second mainspring 30. When the first mainspring 20 and the second mainspring 30 are fully wound, the timepiece 1 of this exemplary embodiment can secure a duration of operation of approximately 100 hours.

When the crown 7 is pulled to the 1-step position and rotated, the date indicator 6 can be moved to adjust the date. When the crown 7 is pulled to the 2-step position, the seconds hand 4C stops, and when the crown 7 is rotated in the 2-step position, the hour hand 4A and the minute hand 4B can be moved to adjust the time. A method of correcting the date indicator 6, the hour hand 4A, and the minute hand 4B by the crown 7 is the same as that for a mechanical timepiece in the related art, and thus descriptions thereof will be omitted.

Movement

Next, the movement 10 will be described with reference to FIGS. 2 to 6. Note that FIG. 2 is a plan view of a main portion of the movement 10 as viewed from the dial side, FIG. 3 is a plan view of the main portion of the movement 10 as viewed from the case back side, FIG. 4 and FIG. 5 are cross-sectional views of the main portion of the movement 10, and FIG. 6 is a perspective view illustrating the main portion of the movement 10.

The movement 10 includes a first barrel 21 in which the first mainspring 20 is housed and a second barrel 31 in which the second mainspring 30 is housed. The hour hand 4A, the minute hand 4B, the seconds hand 4C, and the power reserve hand 5 are attached to a hand spindle of the movement 10 and driven by the first mainspring 20 and the second mainspring 30 of the movement 10, as described later.

Figure 4:
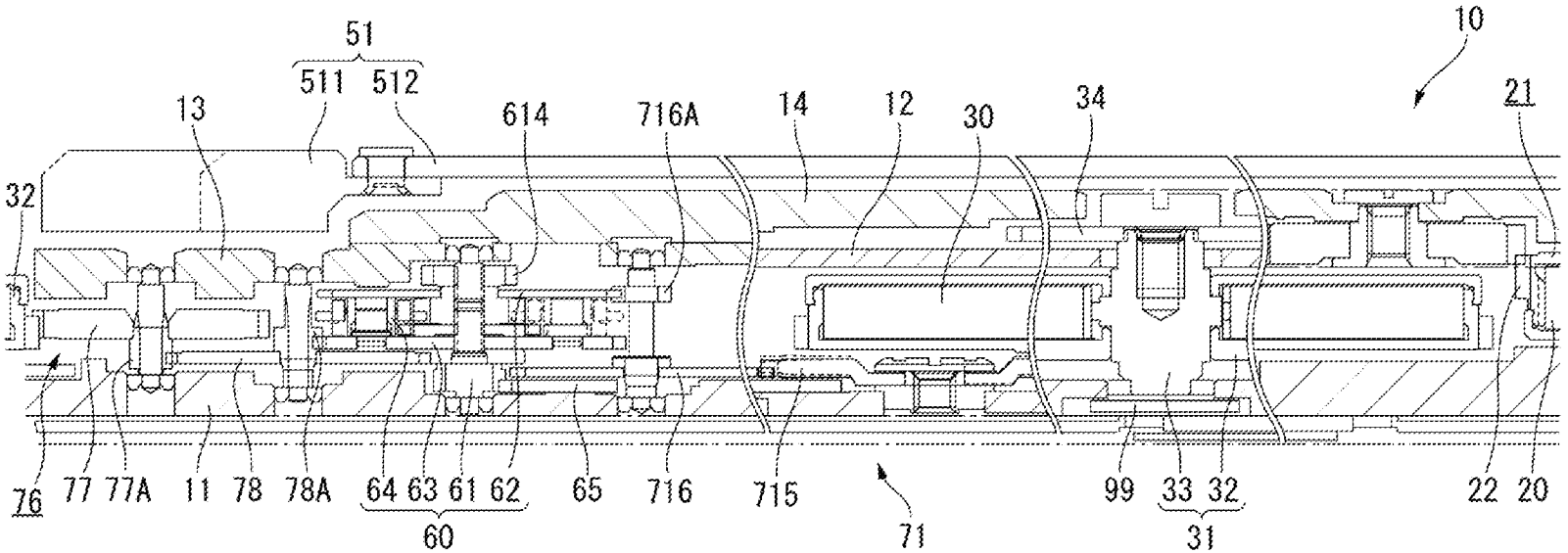
FIG. 4 is a cross-sectional view illustrating the main portion of the movement of the timepiece of the first exemplary embodiment.
Figure 5:
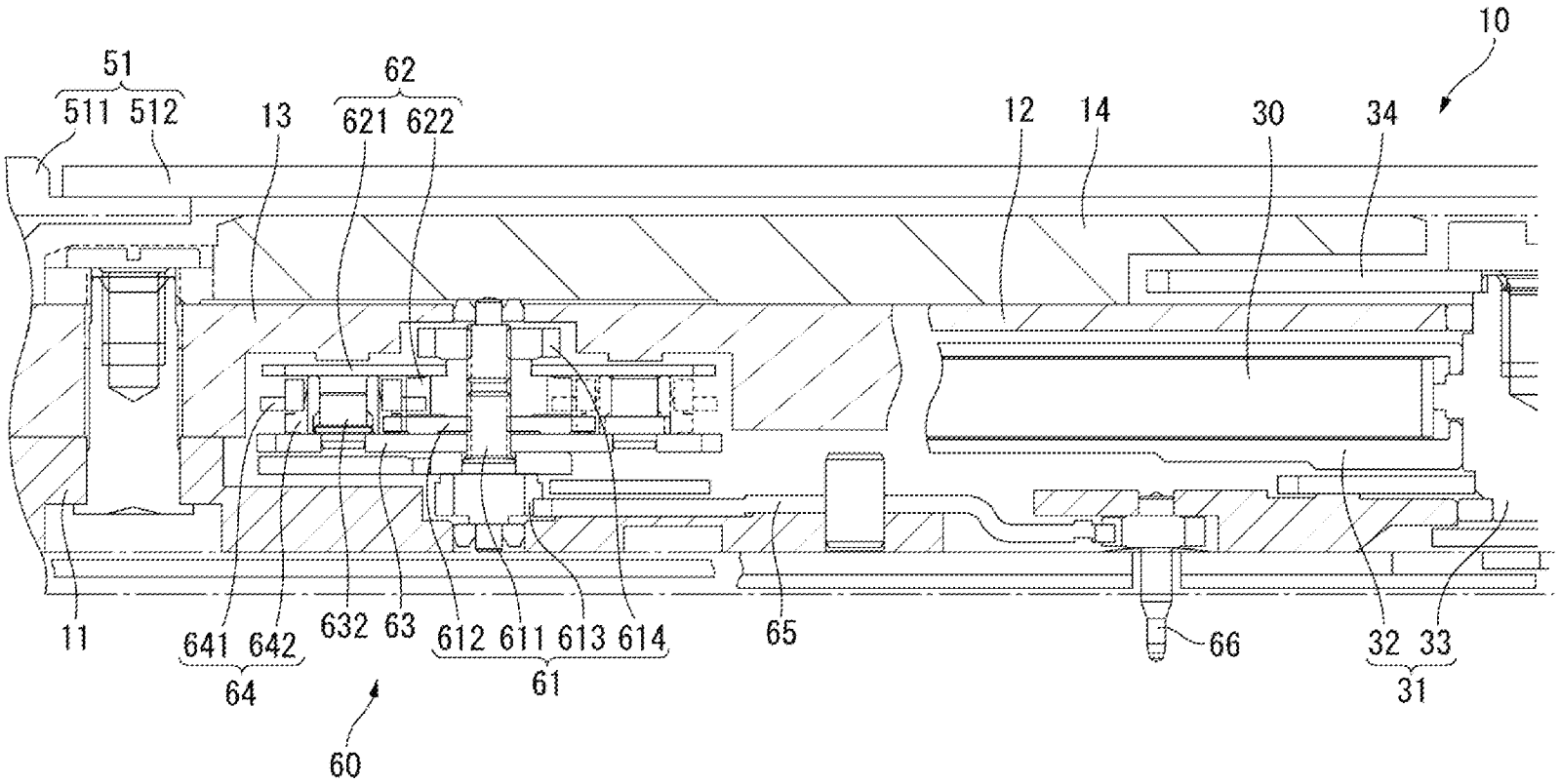
FIG. 5 is a cross-sectional view illustrating the main portion of the movement of the timepiece of the first exemplary embodiment.
Figure 6:
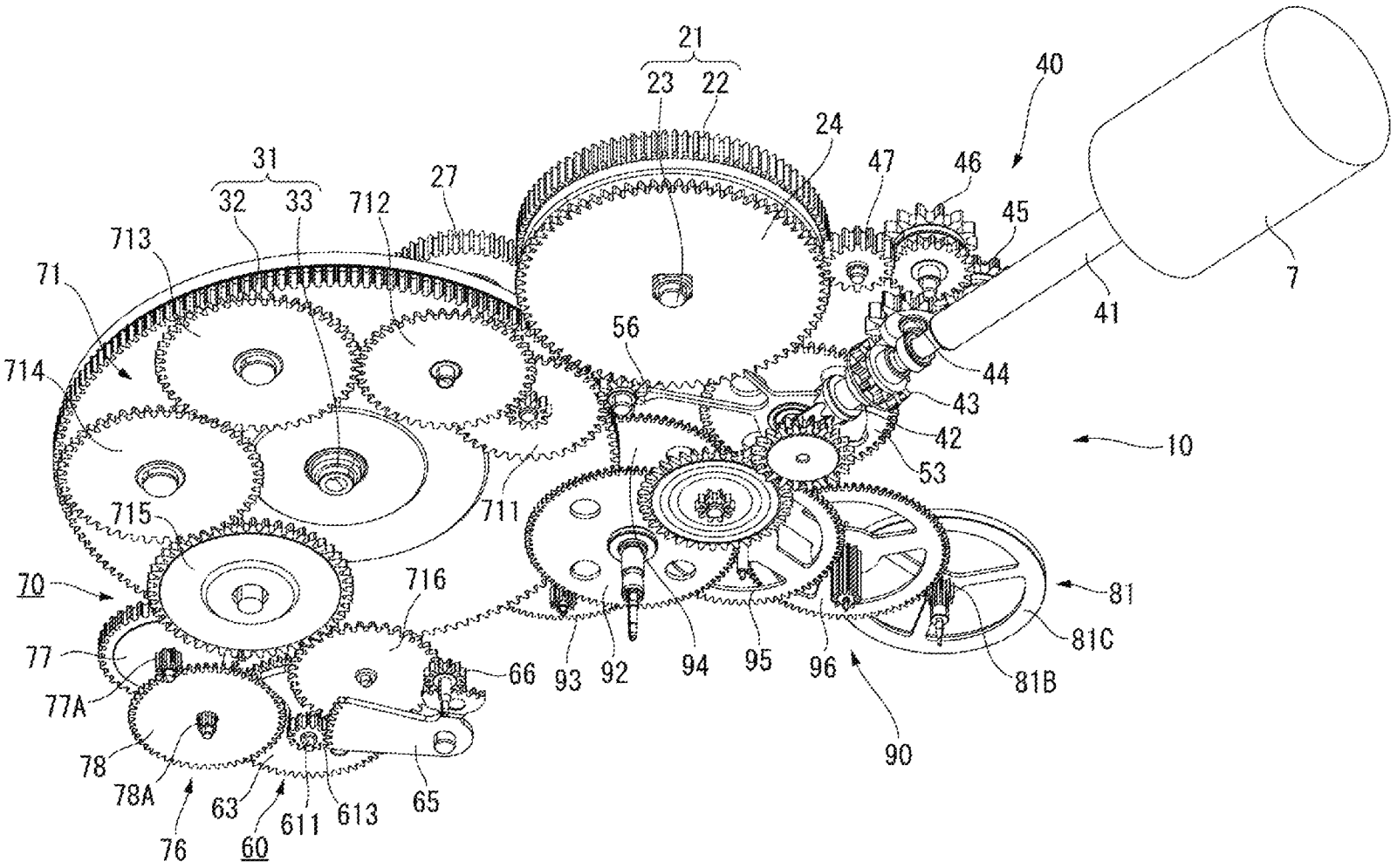
FIG. 6 is a perspective view illustrating the main portion of the movement of the timepiece of the first exemplary embodiment.
Figure 7:
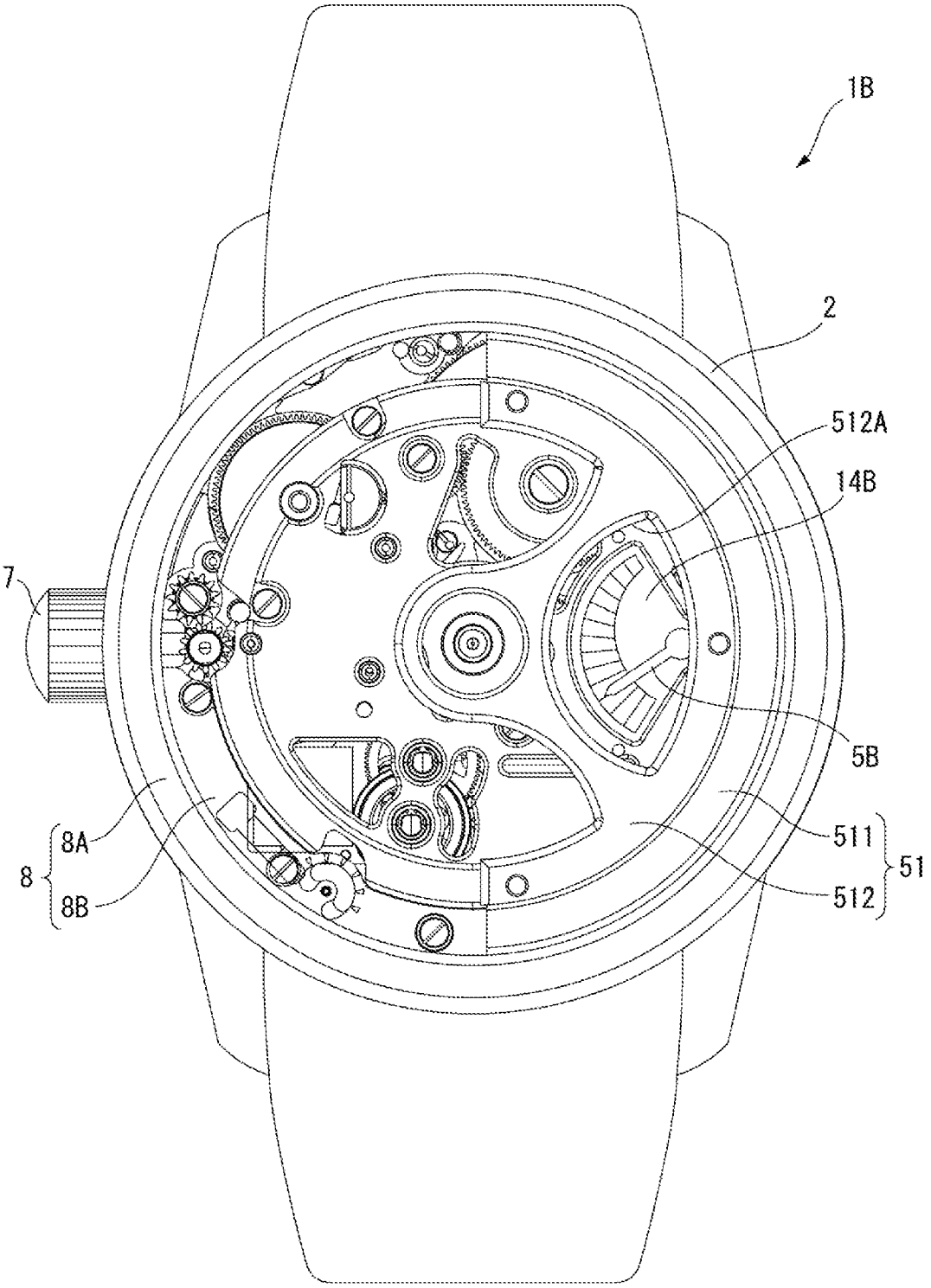
FIG. 7 is a back view illustrating a timepiece of a second exemplary embodiment.

The movement 10 includes a main plate 11, a first barrel and train wheel bridge 12, a second barrel and train wheel bridge 13, and a train wheel bridge 14, as illustrated in FIGS. 4 and 5. As illustrated in FIG. 3, the first barrel 21 in which the first mainspring 20 is housed, the second barrel 31 in which the second mainspring 30 is housed, and a manual winding mechanism 40 and an automatic winding mechanism 50 configured to wind the first mainspring 20 and the second mainspring 30 are disposed between the main plate 11 and the train wheel bridge 14. Further, a power reserve display mechanism configured to display the remaining amount of windup of the first mainspring 20 and the second mainspring 30, a train wheel 90 configured to transmit a torque of the first mainspring 20 and the second mainspring 30, and a power generator 80 driven by the torque transmitted via the train wheel 90 are disposed between the main plate 11 and the second barrel and train wheel bridge 13 as well as the train wheel bridge 14.

First Mainspring and First Barrel

The first mainspring 20 is housed in the first barrel 21. The first barrel 21 includes a first barrel complete 22 and a first barrel arbor 23. As illustrated in FIG. 6 as well, the first barrel arbor 23 is fitted with a first ratchet wheel 24 configured to rotate integrally with the first barrel arbor 23.

Manual Winding Mechanism

As illustrated in FIGS. 3 and 6, the manual winding mechanism 40 includes a winding stem 41 provided with the crown 7 attached thereto, a clutch wheel 42, a winding pinion 43, a crown wheel 44, a ratchet first transmission wheel 45, a ratchet second transmission wheel 46, and a ratchet third transmission wheel 47. The ratchet third transmission wheel 47 intermeshes with the first ratchet wheel 24.

Therefore, when the user rotates the crown 7 in the 0-step position, the winding stem 41 and the clutch wheel 42 rotate. When the crown 7 is in the 0-step position, the clutch wheel 42 intermeshes with the winding pinion 43, and the rotation of the clutch wheel 42 is sequentially transmitted from the winding pinion 43 to the crown wheel 44, the ratchet first transmission wheel 45, the ratchet second transmission wheel 46, and the ratchet third transmission wheel 47. Thus, the first ratchet wheel 24 and the first barrel arbor 23 are rotated, and the first mainspring 20 is wound.

Automatic Winding Mechanism

The automatic winding mechanism 50 includes an oscillating weight 51 illustrated in FIG. 4, a bearing (not illustrated) configured to rotatably axially support the oscillating weight 51 and including a gear configured to rotate integrally with the oscillating weight 51 on an outer ring, and an eccentric wheel 53, a pawl lever 54, and a transmission wheel illustrated in FIG. 3 and configured to intermesh with the gear of this bearing.

The oscillating weight 51 includes a weight 511 and a weight 512.

The eccentric wheel 53 rotates in both a normal direction and a reverse direction by the rotation of the oscillating weight 51. The pawl lever 54 is rotatably attached to the eccentric wheel 53 by a shaft eccentric to a rotary shaft of the eccentric wheel 53.

When the eccentric wheel 53 rotates in tandem with the oscillating weight 51, the pawl lever 54 attached to the eccentric wheel 53 advances and retreats in a direction toward and away from the transmission wheel 55, and rotates the transmission wheel 55 in one direction. As illustrated in FIG. 6, the transmission wheel 55 is integrally provided with a second transmission wheel 56 that intermeshes with the first ratchet wheel 24, and the first ratchet wheel 24 rotates in tandem with the rotation of the second transmission wheel 56. When the first ratchet wheel 24 rotates, the first barrel arbor 23 rotates integrally with the first ratchet wheel 24, and the first mainspring 20 is wound.

Accordingly, according to the timepiece 1 of this exemplary embodiment, the first mainspring 20 can be wound both by hand winding by operation of the crown 7 and by automatic winding by rotation of the oscillating weight 51.

Second Mainspring and Second Barrel

The second mainspring 30 is housed in the second barrel 31, as illustrated in FIG. 3 to FIG. 5. The second barrel 31 includes a second barrel complete 32 and a second barrel arbor 33. The second barrel arbor 33 is integrally rotatable with the second ratchet wheel 34.

The second mainspring 30 is wound by the first mainspring 20. That is, when the first mainspring 20 is wound and a torque capable of winding the second mainspring 30 is accumulated, the first barrel complete 22 of the first barrel 21 rotates. The first barrel complete 22 intermeshes with a second ratchet wheel 34 of the second barrel 31 with a barrel intermediate wheel 27 interposed therebetween, and when the first barrel complete 22 rotates, the second ratchet wheel 34 and the second barrel arbor 33 rotate, and the second mainspring 30 is wound.

Accordingly, in the timepiece 1 of this exemplary embodiment, the first mainspring 20 and the second mainspring 30 can be wound by both the manual winding mechanism 40 and the automatic winding mechanism 50. Note that, for the timepiece 1, only one of the manual winding mechanism 40 and the automatic winding mechanism 50 may be provided.

Further, the first barrel 21 and the second barrel 31 are disposed in one of two regions obtained by virtually dividing the main plate 11 into two in an axial direction of the winding stem 41. The axial direction of the winding stem 41 is a direction connecting the hour marks 3B of 3 o'clock and 9 o'clock of the dial 3, and the main plate 11 is virtually divided into the two regions of a 12 o'clock side and a 6 o'clock side. Then, in the timepiece 1 of this exemplary embodiment, the first barrel 21 and the second barrel 31 are disposed in the region of the 12 o'clock side.

Power Reserve Display Mechanism

The timepiece 1 includes a power reserve display mechanism configured to display the remaining amount of windup of the first mainspring 20 and the second mainspring 30 serving as a drive source. The power reserve display mechanism includes a planetary gear mechanism 60, a power reserve train wheel 70, the sub-dial 3C having a fan shape, disposed on the dial 3, and illustrated in FIG. 1, and the power reserve hand 5. The sub-dial 3C is provided with a substantially band-like scale to which the power reserve hand 5 points. Note that a duration of operation of the timepiece 1 can be estimated by the remaining amount of windup of the first mainspring 20 and the second mainspring 30 serving as the drive source, and thus, as long as numbers indicating the duration of operation are printed on the scale portion of the sub-dial 3C, the duration of operation can be indicated by the power reserve hand 5.

Here, as illustrated in FIG. 3, the second barrel 31 is disposed between the first barrel 21 and the planetary gear mechanism 60 in plan view. Note that in this exemplary embodiment, a plan view refers to a view from an axial direction of the first barrel arbor 23 and the second barrel arbor 33, and a side view refers to a view from a direction orthogonal to the axial direction of the first barrel arbor 23 and the second barrel arbor 33.

The power reserve train wheel 70 includes a winding display train wheel 71 and an unwinding display train wheel 76, as illustrated in FIG. 6.

The winding display train wheel 71 includes a first planetary transmission wheel 711, a second planetary transmission wheel 712, a third planetary transmission wheel 713, a fourth planetary transmission wheel 714, a fifth planetary transmission wheel 715, and a sixth planetary transmission wheel 716. The first planetary transmission wheel 711 intermeshes with the second transmission wheel 56 and, when the first ratchet wheel 24 is rotated by the manual winding mechanism 40 or the automatic winding mechanism 50, the first ratchet wheel 24, the second transmission wheel 56, the first planetary transmission wheel 711, the second planetary transmission wheel 712, the third planetary transmission wheel 713, the fourth planetary transmission wheel 714, the fifth planetary transmission wheel 715, and the sixth planetary transmission wheel 716 rotate in tandem. As illustrated in FIG. 4, a rotary shaft of the sixth planetary transmission wheel 716 is provided with a pinion 716A that intermeshes with the planetary gear mechanism 60.

The first planetary transmission wheel 711, the second planetary transmission wheel 712, the third planetary transmission wheel 713, the fourth planetary transmission wheel 714, and the fifth planetary transmission wheel 715 are disposed in positions overlapping with the second barrel 31 in plan view. Further, the fifth planetary transmission wheel 715 is disposed from the first planetary transmission wheel 711 along a periphery of the second barrel arbor 33 of the second barrel 31, and disposed in a position not overlapping with the second barrel arbor 33 in plan view.

As illustrated in FIGS. 3, 4, and 6, the unwinding display train wheel 77 includes a seventh planetary transmission wheel 77 and an eighth planetary transmission wheel 78. The seventh planetary transmission wheel 77 includes a pinion 77A that intermeshes with the eighth planetary transmission wheel 78, and the eighth planetary transmission wheel 78 includes a pinion 78A that intermeshes with the planetary gear mechanism 60. The seventh planetary transmission wheel 77 intermeshes with the second barrel complete 32, and when the second barrel complete 32 rotates, the seventh planetary transmission wheel 77 and the eighth planetary transmission wheel 78 rotate in tandem.

The seventh planetary transmission wheel 77 and the eighth planetary transmission wheel 78 are rotatably axially supported by the main plate 11 and the second barrel and train wheel bridge 13.

As illustrated in FIGS. 4 and 5, the planetary gear mechanism 60 includes a first solar wheel 61, a second solar wheel 62, a planetary intermediate wheel 63, and a planetary wheel 64 rotatably supported by the planetary intermediate wheel 63.

As illustrated in FIG. 5, the first solar wheel 61 includes a display arbor 611 rotatably axially supported by the main plate 11 or the like, and a first solar gear 612 fixed to the display arbor 611. A first pinion 613 is integrally formed with a first end portion of the display arbor 611 on the dial 3 side. A second pinion 614 is attached to a second end portion of the display arbor 611 on the case back side. The first pinion 613 and the second pinion 614 rotate integrally with the display arbor 611 and the first solar gear 612. When the power reserve hand is provided on the dial side, the power reserve hand may be driven by the first pinion 613 provided to the display arbor 611 on the dial 3 side. When the power reserve hand is provided on the case back side, the power reserve hand may be driven by the second pinion 614 provided to the display arbor 611 on the case back side.

In this exemplary embodiment, to provide the power reserve hand 5 on the dial 3 side, the power reserve hand 5 is attached to a winding wheel 66 that intermeshes with the first pinion 613 and rotates via a winding intermediate wheel 65 having a lever shape and swingably axially supported by the main plate 11. That is, the winding wheel 66 is rotatably axially supported by the main plate 11, a shaft of the winding wheel 66 passes through the dial 3 and protrudes into the front surface of the dial 3, and the power reserve hand 5 is attached to the shaft.

Accordingly, the winding wheel 66 is a first indicator wheel driven by the first pinion 613 and provided with the power reserve hand 5 serving as the first power reserve hand attached thereto, and the power reserve hand 5 is configured to rotate in tandem with the rotation of the first solar wheel 61.

The second solar wheel 62 includes a second solar gear 621 and a second solar pinion 622 fixed to the second solar gear 621. The second solar pinion 622 is rotatably axially supported by the display arbor 611, and thus the second solar wheel 62 is coaxially rotatably disposed with the first solar wheel 61. The second solar gear 621 intermeshes with the pinion 716A of the sixth planetary transmission wheel 716.

The planetary intermediate wheel 63 is rotatably axially supported by the display arbor 611, and is coaxial with the first solar wheel 61 and the second solar wheel 62. On an outer periphery of the planetary intermediate wheel 63, teeth configured to intermesh with the pinion 78A of the eighth planetary transmission wheel 78 are formed. Further, a rotary shaft 632 having a pin shape is fixed in a position eccentric to a rotary shaft of the planetary intermediate wheel 63.

The planetary wheel 64 includes a planetary gear 641 and a planetary pinion 642 integrally fixed to the planetary gear 641, and is rotatably axially supported by the rotary shaft 632 of the planetary intermediate wheel 63.

The planetary gear 641 intermeshes with the second solar pinion 622 and the planetary pinion 642 intermeshes with the first solar gear 612.

Note that when, in plan view from the direction orthogonal to the dial 3, the timepiece is divided by a line segment connecting a 12 o'clock mark and a 6 o'clock mark of the dial 3 into two regions of a first region including a 3 o'clock mark and a second region including a 9 o'clock mark, the planetary gear mechanism 60 is disposed in the second region. Accordingly, in the planetary gear mechanism 60, the first solar wheel 61 provided with the two pinions of the first pinion 613 and the second pinion 614 is disposed in the second region.

Operation of Power Reserve Display Mechanism

The operation of the first mainspring 20 and the second mainspring 30 in such a power reserve display mechanism during winding and unwinding will now be described.

When the first ratchet wheel 24 is rotated by the manual winding mechanism 40 or the automatic winding mechanism 50, the first barrel arbor 23 rotates, and the first mainspring 20 is wound. Further, as the first barrel arbor 23 rotates, the first planetary transmission wheel 711, the second planetary transmission wheel 712, the third planetary transmission wheel 713, the fourth planetary transmission wheel 714, the fifth planetary transmission wheel 715, and the sixth planetary transmission wheel 716 of the winding display train wheel 71 rotate, and a torque thereof is transmitted to the second solar wheel 62, the planetary wheel 64, and the first solar wheel 61. Here, during the winding of the first mainspring 20 and until the second mainspring 30 is fully wound by the first mainspring 20, the rotation of the second barrel complete 32 of the second barrel 31 slows and substantially stops, and thus the seventh planetary transmission wheel 77 and the eighth planetary transmission wheel 78 of the unwinding display train wheel 76 are in a stopped state, and the planetary intermediate wheel 63 intermeshed with the pinion 78A of the eighth planetary transmission wheel 78 is also in a stopped state. Therefore, the planetary wheel 64 axially supported by the rotary shaft 632 of the planetary intermediate wheel 63 rotates, that is, self-rotates, in situ, thereby causing the first solar wheel 61 and the display arbor 611 to rotate in a first direction. When the first solar wheel 61 and the display arbor 611 rotate in the first direction, the winding wheel 66 rotates via the winding intermediate wheel 65, and the power reserve hand 5 rotates in a clockwise direction, that is, in a direction in which the remaining amount of windup of the mainspring displayed by indication of a mark on the sub-dial 3C is increased.

Further, when the first mainspring 20 and the second mainspring 30 unwind, the first ratchet wheel 24 and the winding display train wheel 71 are stopped, and thus the second solar wheel 62 is also stopped. Then, when the second barrel complete is rotated by the unwinding of the second mainspring 30, a torque thereof is transmitted to the planetary intermediate wheel 63 via the seventh planetary transmission wheel 77 and the eighth planetary transmission wheel 78 of the unwinding display train wheel 76. When the planetary intermediate wheel 63 rotates, the second solar pinion 622 with which the planetary gear 641 of the planetary wheel 64 intermeshes is stopped, and thus the planetary wheel 64 revolves around the second solar pinion 622 while self-rotating. Thus, the first solar gear 612 intermeshing with the planetary wheel 64 rotates in a second direction, which is a reverse direction of that during the winding operation of the first mainspring 20 and the second mainspring 30. When the first solar gear 612 rotates in the second direction, the display arbor 611 also rotates in the second direction, the rotation is transmitted to the winding wheel 66 via the winding intermediate wheel 65, and the power reserve hand 5 rotates in a counterclockwise direction, which is a reverse direction of that during the winding operation.

Generator

As illustrated in FIG. 3, the generator 80 is configured to include a rotor 81 and coil blocks 82, 83. The rotor 81 includes a rotor magnet 81A, a rotor pinion 81B, and a rotor inertia disk 81C. The rotor inertia disk 81C reduces a fluctuation in a rotational speed of the rotor 81 relative to a driving torque fluctuation from the second barrel complete 32. The coil blocks 82, 83 are configured by winding a coil on each core.

Accordingly, when the rotor 81 rotates due to torque from the outside, the generator 80 can generate induced electromotive force by the coil blocks 82, 83, output electrical energy, and supply the electrical energy to an integrated circuit (IC) or the like. Further, braking can be applied to the rotor 81 by short-circuiting a coil, and a rotation cycle of the rotor 81 can be constantly adjusted by controlling a braking force.

When the main plate 11 is divided into two regions of the 12 o'clock side and the 6 o'clock side, this generator 80 is disposed in the region of the six o'clock side, that is, in a region different from the region of the 12 o'clock side where the first barrel 21 and the second barrel 31 are disposed.

Train Wheel

Next, the train wheel 90 configured to drive the hour hand 4A, the minute hand 4B, and the seconds hand 4C by mechanical energy from the first mainspring 20 and the second mainspring 30 will be described.

As illustrated in FIGS. 3 and 6 as well, the train wheel 90 includes a center wheel and pinion 92, a third wheel and pinion 93, a fourth wheel and pinion 94, a fifth wheel and pinion 95, and a sixth wheel and pinion 96. The rotation of the second barrel complete 32 is transmitted to the second wheel and pinion 92, subsequently sequentially increases speeds of the third wheel and pinion 93, the fourth wheel and pinion 94, the fifth wheel and pinion 95, and the sixth wheel and pinion 96, and is transmitted to the rotor 81.

The second wheel and pinion 92 is fixed to the minute hand 4B via a cannon pinion (not illustrated), and the seconds hand 4C is fixed to the fourth wheel and pinion 94. Further, an hour wheel 97 illustrated in FIG. 2 is coupled, via a minute wheel (not illustrated), to the cannon pinion, and the hour hand 4A is fixed to this hour wheel 97.

The hour wheel 97 is provided with a date indicator intermediate driving wheel 97A attached thereto, and a date indicator driving wheel 98 rotated by the date indicator intermediate driving wheel 97A is provided with a date indicator driving finger configured to rotate the date indicator 6.

Further, a date jumper 99 configured to suppress a rattling of the date indicator 6 is engaged with inner teeth of the date indicator 6. In this exemplary embodiment, the date jumper 99 is swingably attached by a shaft member 100 attached to the main plate 11.

In the timepiece 1 described above, an alternating current output from the generator 80 is boosted and rectified through a rectifier circuit including boost rectification, full-wave rectification, half-wave rectification, transistor rectification, and the like, and charged to a smoothing capacitor, and a rotation control device (not illustrated) configured to control the rotation cycle of the generator 80 is actuated by power from this capacitor. Note that the rotation control device is constituted by an integrated circuit including an oscillation circuit, a frequency divider circuit, a rotation detection circuit, a rotational speed comparison circuit, electromagnetic brake control means, and the like, and a crystal oscillator is used in the oscillation circuit.

Advantageous Effects of First Exemplary Embodiment

In the timepiece 1 of the first exemplary embodiment, the first solar wheel 61 of the planetary gear mechanism 60 is provided with the two pinions of the first pinion 613 and the second pinion 614 on the first end portion and second end portion of the display arbor 611 on the dial side and on the case back side, respectively, and thus, to dispose the power reserve hand 5 visually recognizable from the front side of the timepiece 1, the winding intermediate wheel 65 that intermeshes with the first pinion 613 and the winding wheel 66 that intermeshes with the winding intermediate wheel 65 may be disposed, and the power reserve hand 5 may be attached to the shaft of the winding wheel 66.

Accordingly, by adding the winding intermediate wheel 65 and the winding wheel 66 to the movement 10, it is possible to manufacture the timepiece 1 having a design that includes the power reserve hand 5 on the timepiece front surface side. Therefore, the movement 10 can be made into a component common to a timepiece having a design that includes the power reserve hand on the case back side, making it possible to reduce a manufacturing burden and reduce a manufacturing cost of the timepiece 1.

The winding wheel 66 provided with the power reserve hand 5 attached thereto intermeshes with the first pinion 613 with the winding intermediate wheel 65 interposed therebetween, and thus the winding wheel 66 can be disposed in a position different from that of the first solar wheel 61 in plan view. Therefore, a degree of freedom of the position in which the winding wheel 66 is disposed can be improved and, even in a case in which the date indicator 6 is provided, the winding wheel 66 can be easily disposed in a position that does not interfere with the date indicator 6.

Further, the planetary gear mechanism 60 including the first solar wheel 61 is disposed in the second region, that is, the 9 o'clock side, of the dial 3, making it possible to easily lay out the components of the movement 10 without interference with the manual winding mechanism 40, such as the winding stem 41 disposed on the 3 o'clock side.

Concave portions are formed in the main plate 11 and the second barrel and train wheel bridge 13 to secure a space in which the first pinion 613 and the second pinion 614 of the first solar wheel 61 are disposed, making it possible to suppress an increase in a thickness dimension of the movement 10 even when the first solar wheel 61 including the first pinion 613 and the second pinion 614 is used. As a result, the thickness dimension of the movement 10 can be similar to that of a movement exclusively used in a timepiece having a design including the power reserve hand on the timepiece front surface side or a movement exclusively used in a timepiece having a design including the power reserve hand on the timepiece back side in the related art, and the movement 10 can be incorporated into the outer case 2 utilized in the related art as well.

The second barrel 31 is disposed between the first barrel 21 and the planetary gear mechanism 60 in plan view viewing the movement 10 from the axial direction of the first barrel arbor 23 and the second barrel box arbor 33, making it possible to streamline a cross-sectional layout and a planar layout of the movement 10. In particular, in the movement 10, while the first barrel 21, the second barrel 31, and the planetary gear mechanism 60 are components having large thickness dimensions, these components can be disposed without overlapping in plan view, making it possible to suppress the thickness dimension of the movement 10.

The first barrel 21 and the second barrel 31 are disposed in one region of the regions obtained by dividing the main plate 11 into two in the axial direction of the winding stem 41, specifically, the region of the 12 o'clock side, making it possible to dispose the generator 80 in the other region, specifically, the region of the 6 o'clock side. Thus, the first mainspring 20 and the second mainspring 30 are used as the drive source, and the rotation control circuit is actuated by the power generated by the generator 80 to precisely adjust the rotation of the generator 80, that is, the rotational speed of the train wheel 90, making it possible to provide an electronically controlled mechanical timepiece that can smoothly operate the hour hand 4A, the minute hand 4B, and the seconds hand 4C with high precision.

The timepiece 1 includes the two mainsprings of the first mainspring 20 and the second mainspring 30, making it possible to provide the movement 10 having a long duration of operation while suppressing a planar size. That is, in the movement 10, the center wheel and pinion 92 provided with the minute hand 4B attached thereto and the fourth wheel and pinion provided with the seconds hand 4C attached thereto are disposed in a planar center position, making it possible to dispose the first barrel 21 and the second barrel 31 within a range from a planar center to an outer periphery of the main plate 11. Accordingly, in order to extend the duration of operation with one mainspring, a diameter of the barrel complete is also increased, and a planar size of the movement 10 is also increased.

In response, in the timepiece 1 of this exemplary embodiment, the two mainsprings of the first mainspring 20 and the second mainspring 30 are provided, making it possible to decrease the planar size of the movement 10 compared to when the same duration of operation is secured with one mainspring.

Furthermore, the first barrel 21 in which the first mainspring 20 is housed is provided on the 1 to 2 o'clock position side in plan view of the dial 3, making it possible to dispose the first barrel 21 near the manual winding mechanism 40. As a result, a number of gears in the manual winding mechanism 40 can be suppressed, and the layout can be streamlined.

Moreover, a diameter of the first barrel 21 is made smaller than that of the second barrel 31, making it possible to dispose a button switch around a periphery thereof. This makes it possible to utilize the same movement 10 when configuring a multifunctional timepiece having a counting function or the like, which requires an increase in a number of buttons.

Second Exemplary Embodiment

Next, a timepiece 1B of a second exemplary embodiment will be described on the basis of FIG. 7 to FIG. 10.

The timepiece 1B differs from the timepiece 1 of the first exemplary embodiment in that a power reserve hand 5B visually recognizable from the timepiece back surface side is provided. In the timepiece 1B, the same or similar components as those of the timepiece 1 are denoted using the same reference numerals, and detailed description thereof will be omitted or simplified.

The timepiece front surface side of the timepiece 1B differs from that of the timepiece 1 illustrated in FIG. 1 in that the front surface side does not include the sub-dial 3C or the power reserve hand 5. Therefore, illustrations thereof are omitted.

On the timepiece back surface of the timepiece 1B, a case back 8 is disposed. The case back 8 is constituted by a frame 8A having a ring shape and a case back glass 8B attached to the frame 8A. Thus, the timepiece 1B is a skeleton type allowing visual recognition of a timepiece interior from the case back 8.

An opening 512A is formed in the weight body 512 of the oscillating weight 51, and thus the power reserve hand 5B is configured to be less likely visually unrecognizable according to the position of the oscillating weight 51.

Similar to the sub-dial 3C, a scale portion 14B having a fan shape is provided on a back surface of the train wheel bridge 14. The power reserve hand 5B points to this scale portion 14B, thereby indicating the remaining amount of windup of the mainspring.

Figure 8:
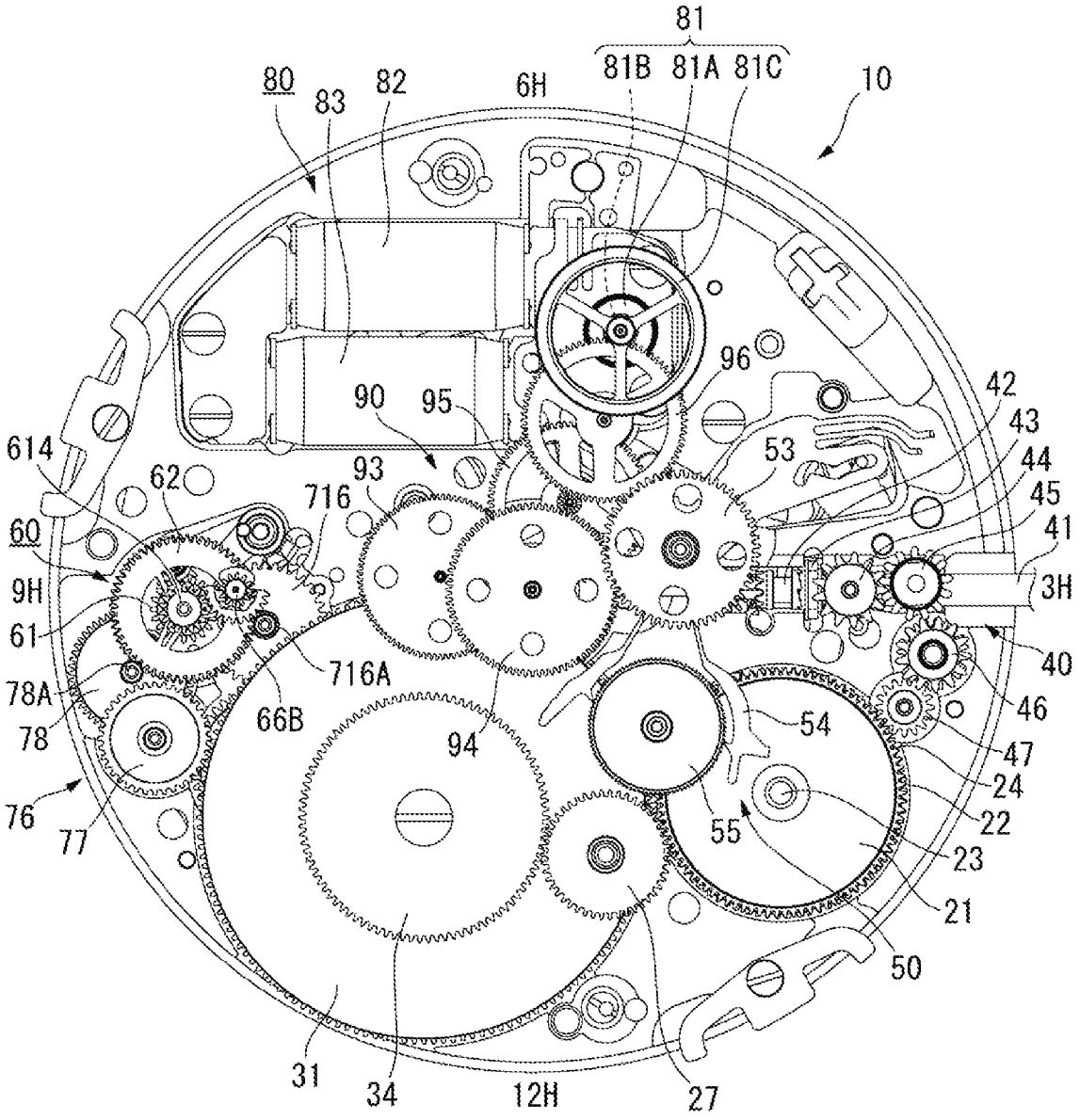
FIG. 8 is a plan view illustrating a main portion of the movement of the timepiece of the second exemplary embodiment.

Next, a structure for driving the power reserve hand 5B will be described. As illustrated in FIG. 8, the movement 10 of the timepiece 1B includes a winding wheel 66B that intermeshes with the second pinion 614 of the first solar pinion 61, and is not provided with the winding intermediate wheel 65 and the winding wheel 66.

Figure 9:
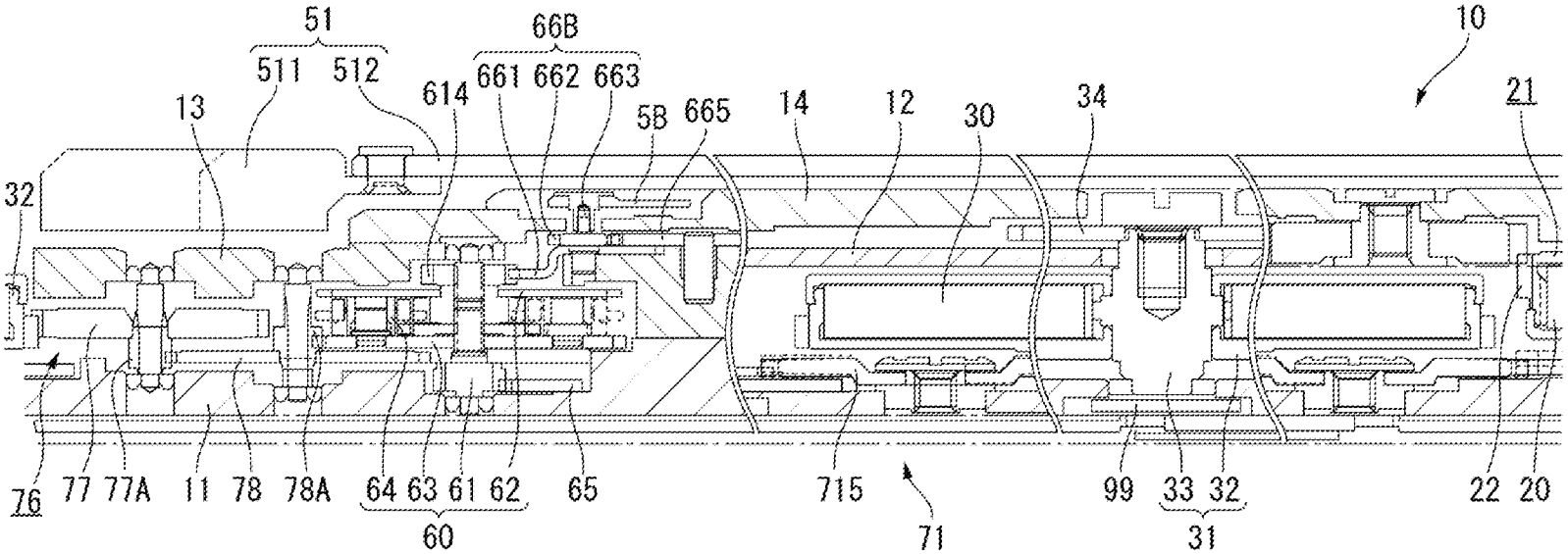
FIG. 9 is a cross-sectional view illustrating the main portion of the movement of the timepiece of the second exemplary embodiment.
Figure 10:
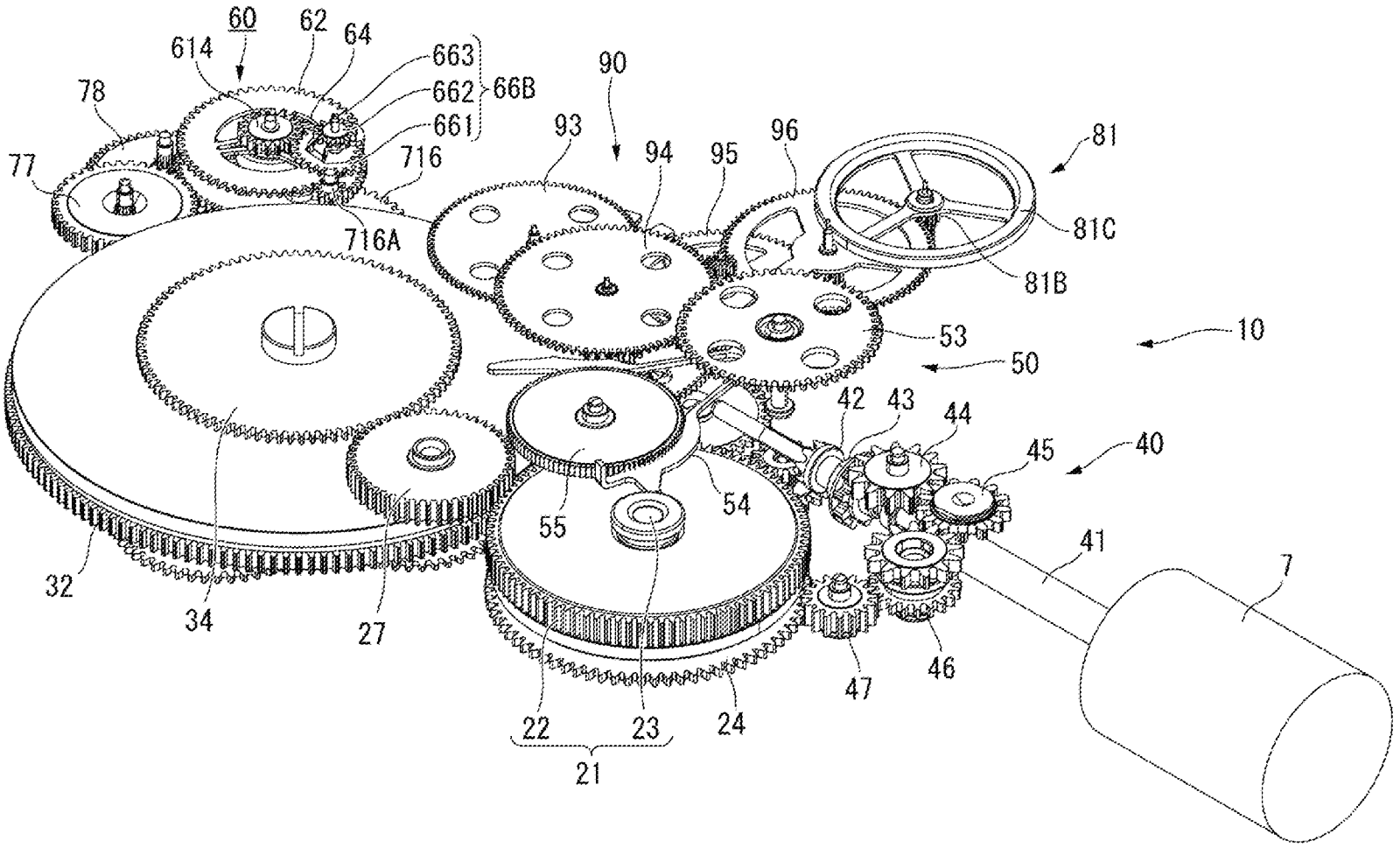
FIG. 10 is a perspective view illustrating the main portion of the movement of the timepiece of the second exemplary embodiment.

As illustrated in FIG. 9, the winding wheel 66B includes a first gear 661, a second gear 662, and a shaft 663. The first gear 661 is a gear that is formed in a substantially semi-circular planar shape and intermeshes with the second pinion 614. The second gear 662 is a gear that intermeshes with a gear 665 axially supported by the second barrel and train wheel bridge 13. The gear 665 is provided to reduce backlash between the gears of the winding wheel 66B and the second pinion 614. A side surface of the gear 665 is biased by a spring (not illustrated) that provides a force in an unwinding direction of the second mainspring 30, and the winding wheel 66B is returned in the unwinding direction of the second mainspring 30 via the gear 665. According to this configuration, indication variation of the power reserve hand 5B can be reduced and suppressed. Note that a structure may be configured without the spring for reducing the backlash described above. Note that the gear 665 is not illustrated in FIG. 8.

The power reserve hand 5B is attached to the shaft 663 of the winding wheel 66B. Accordingly, the winding wheel 66B is a second indicator wheel driven by the second pinion 614 and provided with the power reserve hand 5B, which is a second power reserve hand, attached thereto.

The other components are the same as those of the timepiece 1 of the first exemplary embodiment and thus denoted using the same reference numerals as in FIGS. 7 to 10, and descriptions thereof will be omitted.

Advantageous Effects of Second Exemplary Embodiment

In the timepiece 1B of the second exemplary embodiment, the first solar wheel 61 of the planetary gear mechanism 60 is provided with the two pinions of the first pinion 613 and the second pinion 614 and thus, by disposing the winding wheel 66B that intermeshes with the second pinion 614 and attaching the power reserve hand 5B to the shaft 663 of the winding wheel 66B, it is possible to dispose the power reserve hand 5B visually recognizable from the back surface side of the timepiece 1B.

That is, by adding the winding wheel 66B and the gear 665 to the movement 10, it is possible to manufacture the timepiece 1B having a design including the power reserve hand 5B on the timepiece back surface side. Therefore, the movement 10 can be made into a component common to the timepiece 1 having a design that includes the power reserve hand 5 on the front surface side, making it possible to reduce a manufacturing burden and reduce a manufacturing cost of the timepiece 1B.

Furthermore, because the movement 10 can be made into a common component, it is possible to achieve the same advantageous effects as those of the timepiece 1 of the first exemplary embodiment.

The winding wheel 66B provided with the power reserve hand 5B attached thereto intermeshes with the second pinion 614, and thus the winding wheel 66B can be disposed in a position different from that of the first solar wheel 61 in plan view. Therefore, a degree of freedom of the position in which the winding wheel 66B is disposed can be improved.

Third Exemplary Embodiment

Figure 11:
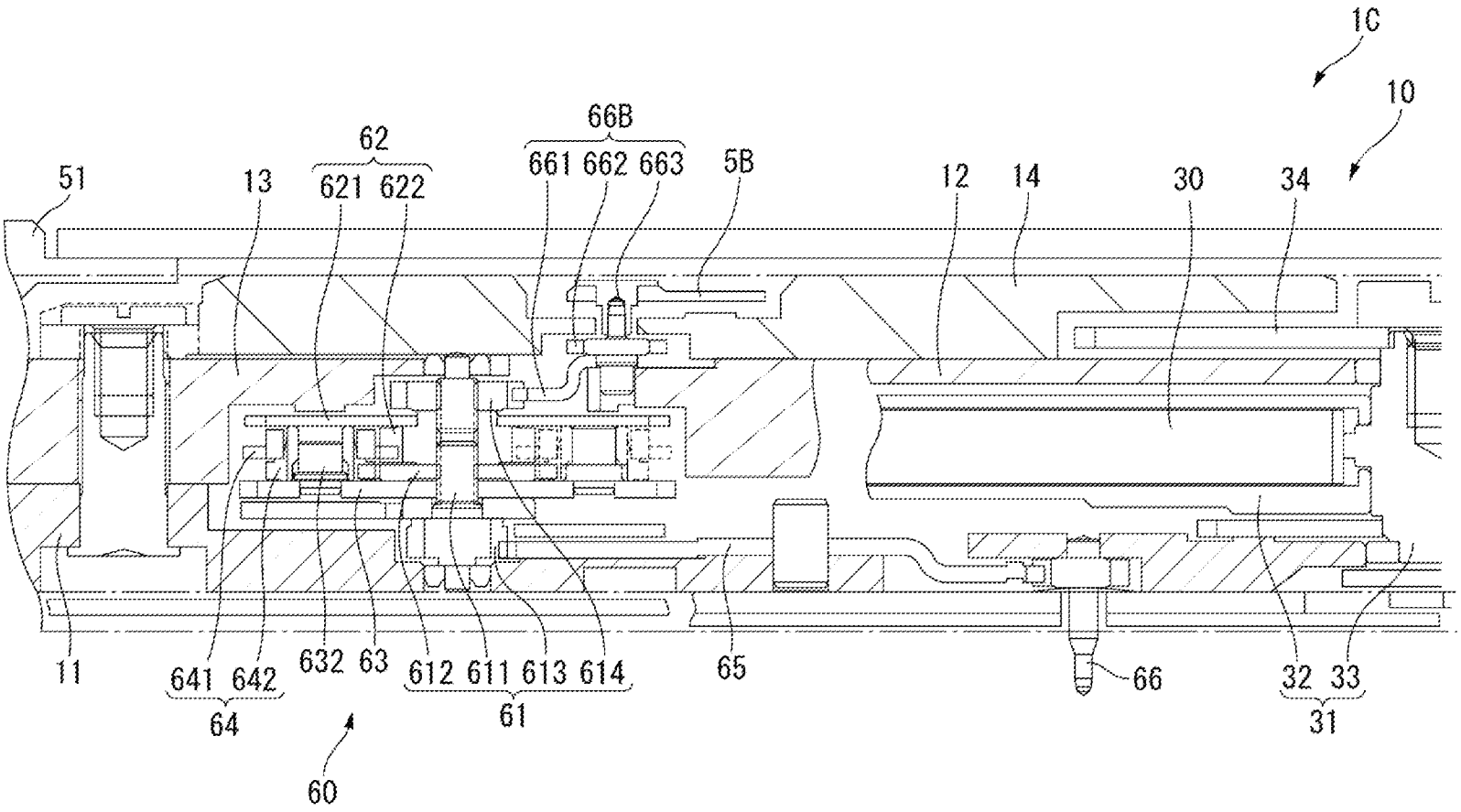
FIG. 11 is a cross-sectional view illustrating a main portion of the movement of a timepiece of a third exemplary embodiment.

Next, a timepiece 1C of a third exemplary embodiment will be described on the basis of FIG. 11.

The timepiece 1C is provided with two power reserve hands, that is, the power reserve hand 5 visually recognizable from the timepiece front surface side and the power reserve hand 5B visually recognizable from the timepiece back surface side. The power reserve hand 5 is identical to that of the timepiece 1 and the power reserve hand 5B is identical to that of the timepiece 1B, and thus descriptions thereof will be omitted.

According to the timepiece 1C of the third exemplary embodiment, the two power reserve hands 5, 5B are provided, and thus the remaining amount of windup of the first mainspring 20 and the second mainspring 30 can be displayed from both the timepiece front surface side and the timepiece back surface side of the timepiece 1C, and thus user-friendliness can be improved.

Other Exemplary Embodiments

Note that the present disclosure is not limited to each of the exemplary embodiments described above, and variations, modifications, and the like within the scope in which the object of the present disclosure can be achieved are included in the present disclosure.

While, in the exemplary embodiments described above, the winding wheel 66 intermeshes with the first pinion 613 with the winding intermediate wheel 65 interposed therebetween, the winding wheel 66 may directly intermesh with the first pinion 613. On the other hand, while the winding wheel 66B directly intermeshes with the second pinion 614, the winding wheel 66B may be intermeshed with a winding intermediate wheel interposed therebetween.

Further, while, in the planetary gear mechanism 60, the two pinions of the first pinion 613 and the second pinion 614 are provided to the first solar wheel 61, three or more pinions may be provided to the first solar wheel 61. By providing three or more pinions, it is possible to increase design variations of the power reserve mechanism and thus, compared to a case in which two pinions are provided, the product can be deployed with variations in features such as a disposed position and an indicated range of the power reserve hand. However, in a configuration in which three or more pinions are provided, the movement thickness may increase, and thus, when there is a desire to thinly configure the movement and the timepiece, preferably the timepiece is configured with only two pinions.

Further, the timepieces 1, 1B, 1C are not limited to electronically controlled mechanical timepieces that include the generator 80 and the train wheel 90, but may be mechanical timepieces that include a general speed adjustment mechanism such as an escape, a pallet fork, or the like.

Furthermore, while the timepieces 1, 1B, 1C include the two mainsprings of the first mainspring 20 and the second mainspring 30, the timepiece may be a timepiece that includes only one mainspring.

The disposed position of the planetary gear mechanism including the first solar wheel 61 is not limited to the 9 o'clock position of the dial 3 as in the exemplary embodiments described above, and may be an 8 o'clock position or a 10 o'clock position, or may be a 12 o-clock position or a 6 o'clock position. That is, the disposed position of the planetary gear mechanism 60 of the movement 10 and the disposed positions of the power reserve hands 5, 5B may be set as appropriate in accordance with the configuration of the movement 10.

What is claimed is:

1. A timepiece comprising:

a mainspring;

a power reserve hand configured to indicate a remaining amount of windup of the mainspring;

an indicator wheel provided with the power reserve hand attached thereto; and a solar wheel configured to rotate in a first direction when the mainspring is wound, rotate in a second direction reverse to the first direction when the mainspring is unwound, and provided with first and second pinions, wherein the first pinion is provided to an end portion, on a dial side, of a rotary shaft of the solar wheel, the second pinion is provided to an end portion, on a case back side, of the rotary shaft of the solar wheel, the indicator wheel includes:

a first indicator wheel driven by the first pinion; and a second indicator wheel driven by the second pinion, and the power reserve hand includes:

a first power reserve hand attached to the first indicator wheel and arranged to be visually recognizable from a front surface side of the timepiece; and a second power reserve hand attached to the second indicator wheel and arranged to be visually recognizable from a back surface side of the timepiece.

2. The timepiece according to claim 1, comprising:

an intermediate wheel configured to intermesh with the indicator wheel and one of the first pinion the second pinion.

3. The timepiece according to claim 1, wherein when, in a plan view as viewed from a direction orthogonal to the dial, the timepiece is divided by a line segment connecting a 12 o'clock mark and a 6 o'clock mark of the dial into two regions which are a first region including a 3 o'clock mark and a second region including a 9 o'clock mark, the solar wheel is arranged in the second region.

* * * * *